US008297875B1

(12) United States Patent
Kopacz et al.

(10) Patent No.: US 8,297,875 B1
(45) Date of Patent: Oct. 30, 2012

(54) SCREED HEATING CONTROL

(75) Inventors: Jason W. Kopacz, St. Louis Park, MN (US); Anthony P. Steinhagen, Maple Grove, MN (US); Jameson M. Smieja, Brooklyn Park, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 13/165,308

(22) Filed: Jun. 21, 2011

(51) Int. Cl.
*E01C 7/06* (2006.01)
*E01C 23/14* (2006.01)
*E01C 19/22* (2006.01)

(52) U.S. Cl. ..... 404/77; 404/79; 404/118

(58) Field of Classification Search ..... 404/114, 404/118, 120, 77, 79
See application file for complete search history.

(56) References Cited

U.S. PATENT DOCUMENTS

| | | | | |
|---|---|---|---|---|
| 5,417,516 | A * | 5/1995 | Birtchet | 404/71 |
| 6,334,735 | B1 | 1/2002 | Williams et al. | |
| 6,421,594 | B1 | 7/2002 | Erasmus | |
| 6,769,836 | B2 * | 8/2004 | Lloyd | 404/75 |
| 7,217,062 | B2 | 5/2007 | Pisano et al. | |
| 7,641,419 | B1 | 1/2010 | Nelson | |
| 2005/0191127 | A1 * | 9/2005 | Pisano et al. | 404/77 |
| 2009/0257825 | A1 * | 10/2009 | Nelson | 404/95 |

* cited by examiner

*Primary Examiner* — Thomas B Will
*Assistant Examiner* — Abigail A Risic
(74) *Attorney, Agent, or Firm* — Miller, Matthias & Hull

(57) ABSTRACT

A system and method to control heating of a screed assembly in a paving machine is disclosed. The system and method includes providing a plurality of screed elements in communication with a respective one of a plurality of circuit breakers through a respective one of a plurality of relays. The system and method additionally includes providing a control system in communication with the plurality of screed elements and the plurality of relays and, receiving inputs by the control system to generate an output signal based upon the inputs. Heating of each of the plurality of screed elements is accomplished in response to the output signal.

18 Claims, 5 Drawing Sheets

SCREED HEATING CONTROL

TECHNICAL FIELD OF THE DISCLOSURE

The present disclosure relates to paving machines and, more particularly, relates to screed plates employed in paving machines.

BACKGROUND OF THE DISCLOSURE

Paving machines are generally used for laying heated paving material, such as, bituminous aggregate mixtures or asphalt, onto a roadbed. After heated asphalt is laid, it is typically spread, leveled and compacted such that upon cooling, a road with a uniform, smooth surface that becomes passable by vehicles is achieved. In order to spread the heated asphalt, a paving machine, known as a screed, is typically used. Such screeds can be pulled by a tractor, truck or the like or can be self-propelled. The truck or the tractor supplies the asphalt and the screed then heats, vibrates and manipulates the asphalt into a smooth uniform surface. A screed generally employs a screed assembly having one or more screed elements.

Each screed element may have a mechanism for heating the asphalt. Often, screed elements include two main elements provided in the center of the screed, and hydraulically extendable extenders connected to the sides of the two main elements to widen the paving capability of the screed assembly as a whole. In addition to the main elements and the extenders, bolt-on extensions can be connected to the extenders for paving even larger areas. For example, for paving an area greater than five meters, six screed elements including, two main elements, two extenders and two bolt-on extensions may be employed, all of which may be heated as well for ease in manipulating and spreading the heated asphalt.

In order to heat such screed elements, they are generally powered using a generator under control by a control system. The control system directs power to the different sections of the screed elements by reading inputs from temperature sensors located on each of the screed elements. Traditionally, during heat-up of the screed elements, the control system continuously powers (to heat) the two main elements while alternating between the extenders and the bolt-on extensions. Thus, as the main elements reach a desired temperature, power to the main elements is cut-off, while it continues to alternate between the extenders and the bolt-on extensions until they reach the desired temperature as well.

Although the above method of heating the screed elements is effective, it suffers from several disadvantages. For example, the extenders and the bolt-on extensions are only heated at half the power (e.g., because of power switching), while the main elements are heated at full power (e.g., because of receiving continuous power). This causes the main elements to be heated up before the extenders and the bolt-on extensions, resulting not only in extended heat-up time of the screed elements, but also causing potentially cold screed elements and, particularly, cold main elements, which have to wait for the extenders and the bolt-on extensions to reach the desired temperature before being used. It may also result in non-uniform heating of the screed elements, longer paving times and unnecessary power wastage.

It would accordingly be beneficial if an improved mechanism for effectively controlling heating of the screed elements were developed.

SUMMARY OF THE DISCLOSURE

In accordance with one aspect of the present disclosure, a method to control heating of a screed assembly is disclosed.

The method may include providing a plurality of screed elements in communication with a respective one of a plurality of circuit breakers through a respective one of a plurality of relays. The method may further include providing a control system in communication with the plurality of screed elements and the plurality of relays and receiving inputs by the control system and generating an output signal based upon the inputs. The method may additionally include heating each of the plurality of screed elements in response to the output signal.

In accordance with another aspect of the present disclosure, a paving machine is disclosed. The paving machine may include a screed assembly having a plurality of screed elements, a generator having a plurality of circuit breakers, each of the plurality of circuit breakers in communication with a respective one of the plurality of screed elements and a plurality of relays in communication with a respective one of the plurality of circuit breakers. The paving machine may also include a control system capable of receiving a plurality of inputs and generating an output to activate at least two of the plurality of relays.

In accordance with yet another aspect of the present disclosure, a method of heating a screed assembly is disclosed. The method may include providing a screed assembly having six screed elements, each of the six screed elements connected to a respective circuit breaker through a respective relay, providing a control system receiving inputs from each of the six screed elements and determining four coldest of the six screed elements. The method may also include activating the relays of the four coldest of the six screed elements and heating the four coldest of the six screed elements through their respective circuit breakers.

While the present disclosure is susceptible to various modifications and alternative constructions, certain illustrative embodiments thereof, will be shown and described below in detail. It should be understood, however, that there is no intention to be limited to the specific embodiments disclosed, but on the contrary, the intention is to cover all modifications, alternative constructions, and equivalents along within the spirit and scope of the present disclosure.

DETAILED DESCRIPTION OF THE DISCLOSURE

Figure 1:
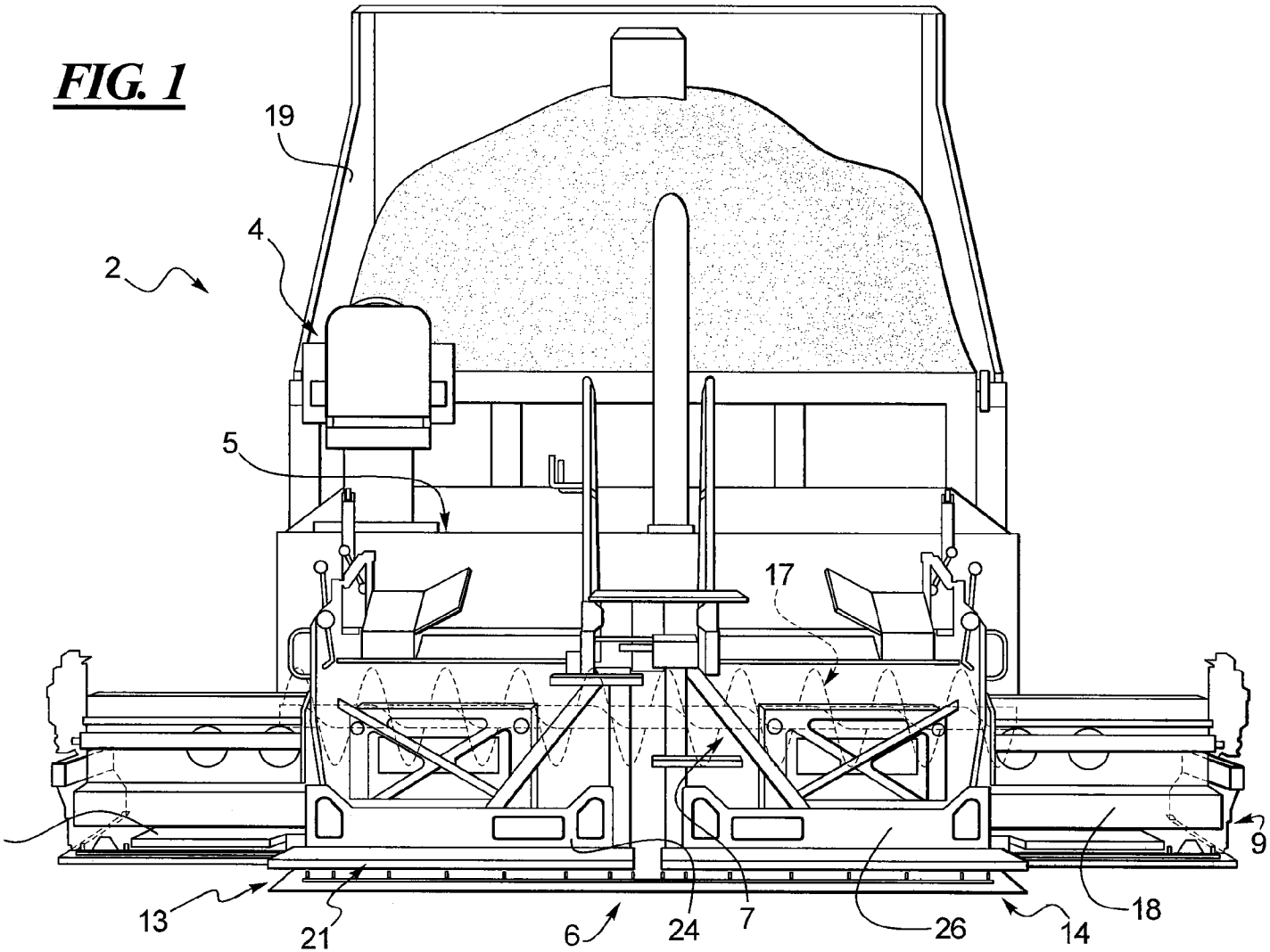
FIG. 1 is a perspective view of an exemplary screed constructed in accordance with the teachings of the present disclosure.

The present disclosure provides a system and method to control heating of a screed assembly in a paving machine with improved efficiency, speed and uniformity as described in detail below. Referring now to FIG. 1, an exemplary paving machine 2 is schematically shown, in accordance with at least some embodiments of the present disclosure. It will be understood that only those components that are essential for a proper understanding of the present disclosure are shown and/or described herein. Nevertheless, several other components that are commonly employed in combination or conjunction with such paving machines are contemplated and considered within the scope of the present disclosure. Thus, as shown, the paving machine 2 may include a tractor 4 towing a screed assembly 6. The tractor 4 may include an engine 5, a transmission 7 and wheels, tracks or other locomotive device 9 for moving the screed assembly 6. Moreover, the tractor 4 may include a hopper 19 for receiving and temporarily storing a supply of asphalt, as well as feeder conveyors or augers 17 for moving the asphalt from the hopper 19 to the screed assembly 6. Once the asphalt reaches the screed assembly 6, the screed assembly may level and shape the asphalt into a layer of desired thickness, size and uniformity. To do so, the screed assembly 6 may employ a number of screed elements 13 (See FIG. 2) as described herein, as well as various leveling arms, mold boards, burners and vibrators, which for conciseness of expression are not described herein. The screed assembly 6 may also include a plurality of walkways 21 to facilitate movement of workers therein when in use.

Figure 2:
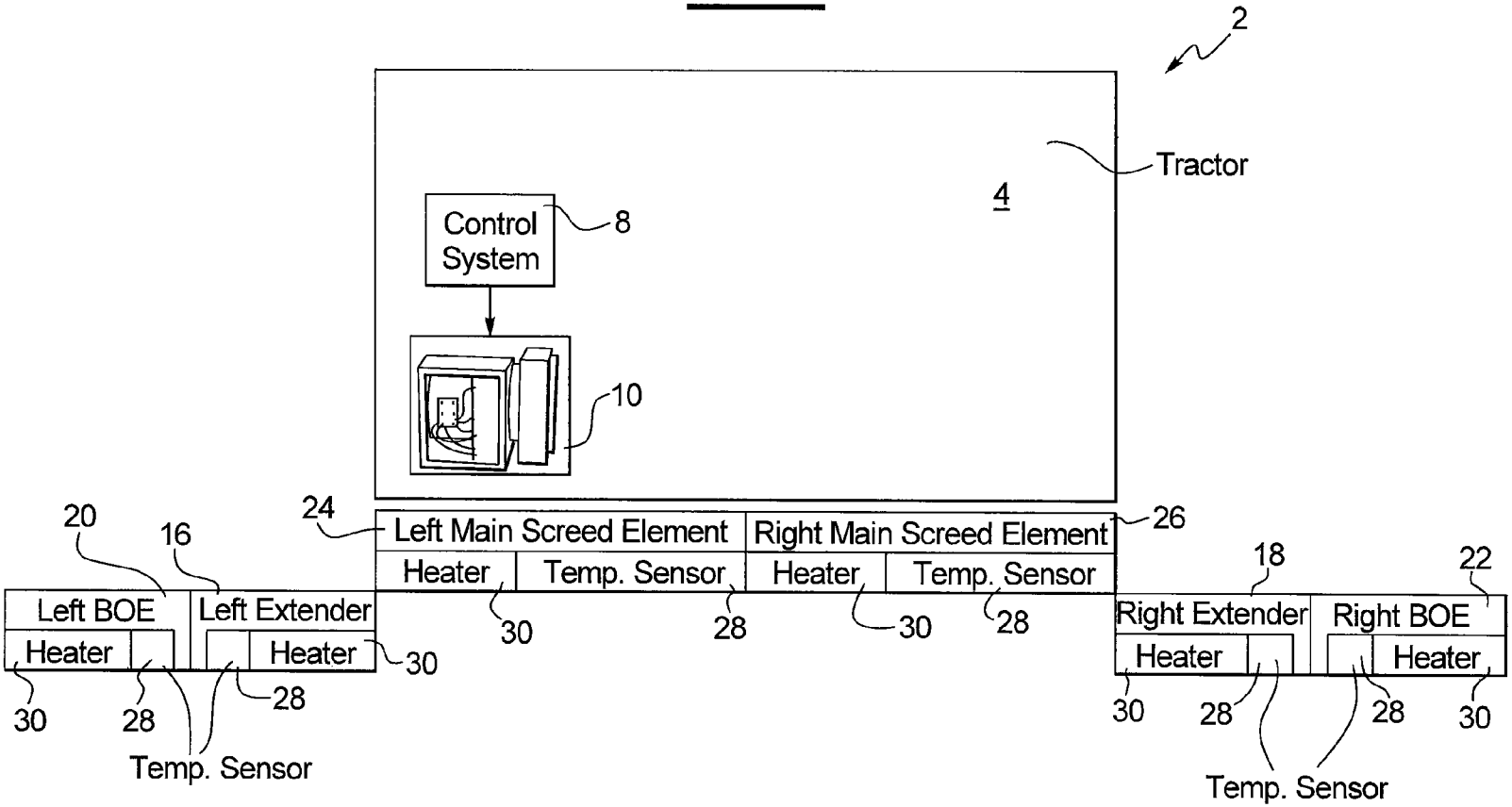
FIG. 2 is a schematic illustration of the screed of FIG. 1, in accordance with at least some embodiments of the present disclosure.

With respect to the screed elements 13, in at least some embodiments, it may include a main screed plate 14, left and right extenders 16 and 18, respectively, and respective left and right bolt-on extensions (BOE) 20 and 22 (See. FIG. 2). The main screed plate 14 may further include left and right main screed elements 24 and 26, respectively. The left extender 16 and the left BOE 20 may be connected to the left of the left main screed element 24 and the right extender 18 and the right BOE 22 may be connected to the right of the right main screed element 26. In at least some embodiments, each of the left and the right extenders 16 and 18, respectively, may be mounted in front or rear of the main screed plate 14 in a manner commonly employed and may be hydraulically controlled. Relatedly, each of the left and the right BOE 20 and 22, respectively, may be hydraulically actuated as well and may also be connected in front or rear of the respective left and the right extenders 16 and 18. Notwithstanding the fact that in the present embodiment, six of the screed elements 13 (the left main screed element 24, the right main screed element 26, the left extender 16, the right extender 18, the left BOE 20 and the right BOE 22) of the screed assembly 6 have been shown, in at least some embodiments, the number of these sections may vary depending particularly upon the width of the paving area.

Referring now to FIG. 2 in conjunction with FIG. 1, each of the screed elements 13 may further include temperature sensors 28 for determining the temperature, as well as heaters or tamper elements 30 for heating the respective screed element. From FIG. 2, it can also be seen that the tractor 4 may house, among other components described above, a control system 8 that may at least indirectly communicate with a generator 10 through a set of relays 12 (See FIG. 3) for heating the screed assembly 6, in a manner described below. Specifically, the screed elements 13 and, particularly the heaters 30, may be powered by the generator 10 through circuit breakers 11, which operate under control of the relays 12, which in turn are selectively activated by the control system 8.

Figure 3:
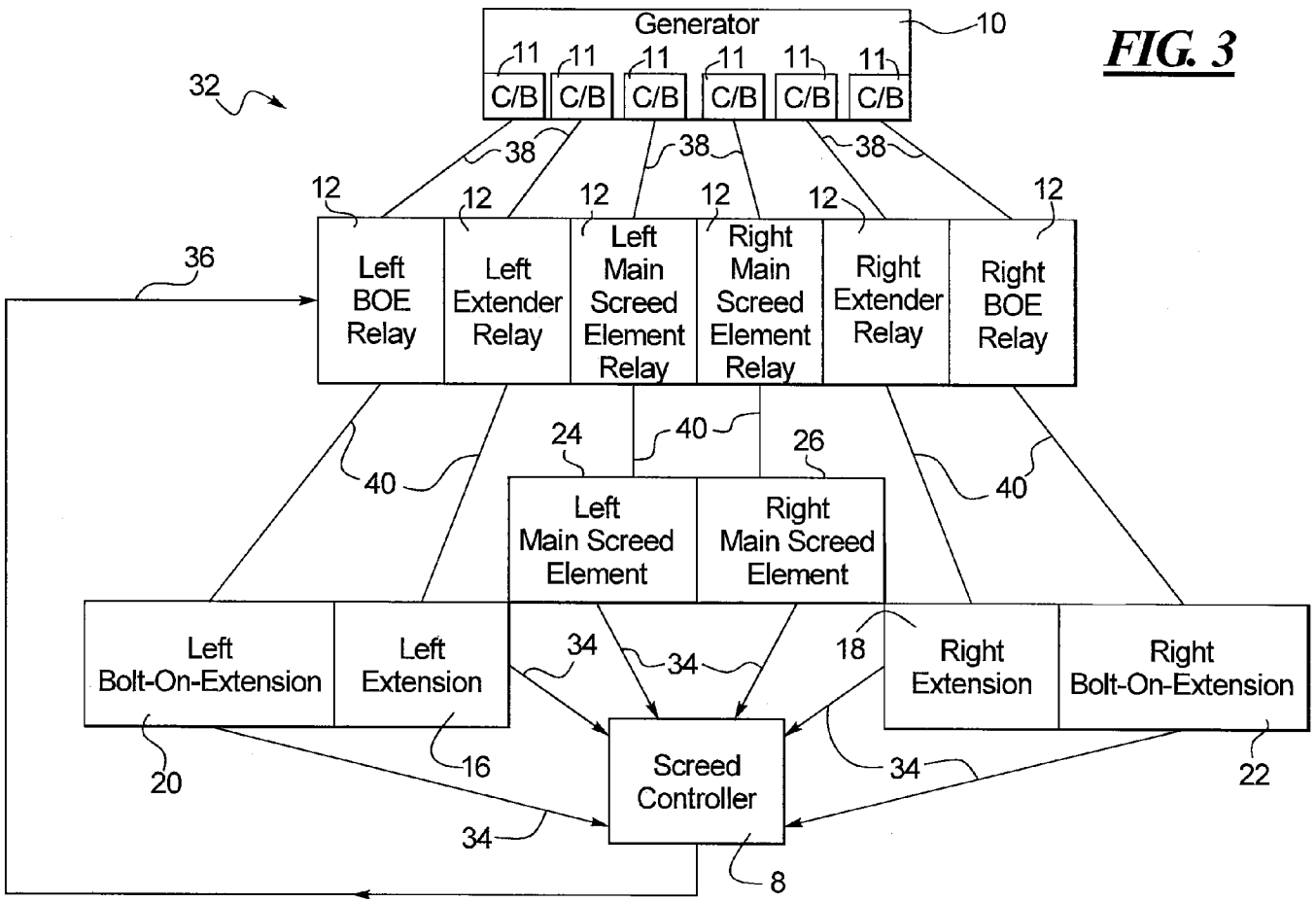
FIG. 3 is a schematic illustration of control flow from a control system for heating a screed assembly of the screed of FIG. 1, in accordance with at least some embodiments of the present disclosure.

In at least some embodiments and, as shown in FIGS. 2 and 3, a dedicated one of the circuit breakers 11, as well a dedicated one of the relays 12 may be provided for each of the screed sections 13. Thus, each of the six screed sections 13 may be directly connected to the generator 10 through a respective one of the circuit breakers 11 and a respective one of the relays 12. Accordingly, for six of the screed sections 13, six of the circuit breakers 11 and six of the relays 12 may be employed for heating those screed sections, as described below.

Furthermore, although only the temperature sensors 28 and the heaters 30 have been shown and described as being present on the screed elements 13, in at least some embodiments, other components that are commonly associated with such screed elements may nonetheless be present and be employed in conjunction or combination therewith.

In at least some embodiments, the control system 8 may be a microprocessor having a memory that may be in wired or wireless communication with the relays 12 and the generator 10. The generator 10 may be any of a variety of alternating current (AC) or direct current (DC) generators that are commonly employed in paving machines. Furthermore, in some embodiments, the generator 10 may be a twenty five kilowatt generator, although other rating generators may be employed in alternate embodiments. In addition, the generator 10 may employ the set of circuit breakers 11 that may be in direct communication with the screed assembly 6 for heating various of the screed elements 13 through a respective one of the relays 12, as described below. The relays 12 in turn may, in at least some embodiments, be dual-pole single or double throw relays although, in other embodiments, other types of relays, such as, single throw relays may be employed. Additionally, the relays 12 may be part of the generator 10 or may be housed separately therefrom on-board the tractor 4 or the screed assembly 6. Relatedly, the circuit breakers 11 may be off-the-shelf ground fault circuit breakers for limiting leakage current, although other types of circuit breakers may be employed.

Furthermore, although the control system 8 and the generator 10 have been shown as being housed within the tractor 4 of the paving machine 2, this need not always be the case. Rather, in other embodiments, one or both of the control system and the generator 8 and 10, respectively, may be located off-board from the tractor 4 and may at least indirectly communicate with one another. The control system 8 may possibly even be located in a remote location for controlling the generator 10 and the relays 12.

Referring now to FIG. 3, a control flow 32 of the control system 8 for heating the screed elements 13 is shown, in accordance with at least some embodiments of the present disclosure. As shown, the control system 8 takes as inputs 34 and generates an output 36. The inputs 34 may be representative of a variety of inputs, such as, temperature readings from the temperature sensors 28 of each of the six screed elements 13, a load factor to convey the load on the engine, and a set point temperature to determine the desired heating temperature of the screed elements. Upon receiving the inputs 34, the control system 8 generates the output 36, which may be directed to selectively activate the relays 12 for controlling heating of the screed elements 13. Each of the relays 12 in turn controls the respective circuit breaker 11 associated therewith, as shown by communication links 38, which in turn powers and heat the respective screed elements 13 through the generator 10, as shown by communication links 40. The number and which of the relays 12 to be activated by the control system 8 is determined based upon logic built-into the control system, as described below with respect to FIG. 4.

INDUSTRIAL APPLICABILITY

In general, the present disclosure sets forth a control system for controlling heating of a screed assembly employed with paving machines. Specifically, the screed assembly includes multiple screed elements and, particularly, six screed elements, each of which is connected to a circuit breaker within a generator via a relay. The control system reads the temperature signal from the temperature sensors of each of the six screed elements and based upon the temperature of those screed elements, the control system intelligently distributes power, as described in FIG. 4, to heat the screed elements.

Figure 4:
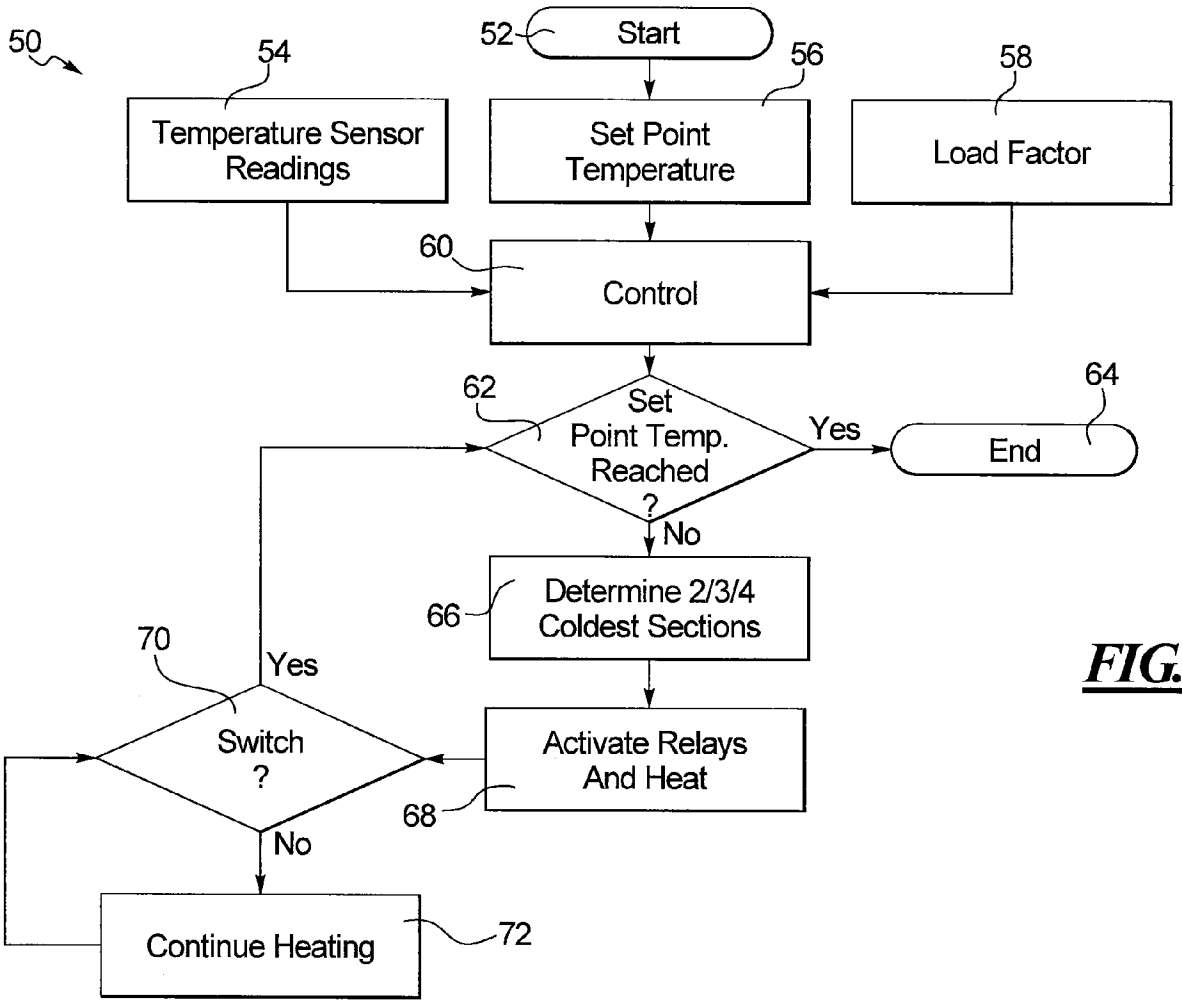
FIG. 4 is a flowchart showing steps of operation of the control system of FIG. 3 in heating the screed assembly of FIG. 1.

Referring now to FIG. 4, a flowchart 50 showing the steps of operation (or logic) of the control system 8 to heat the screed elements 13 is shown, in accordance with at least some embodiments of the present disclosure. As shown, the process starts at a step 52, with the control system being turned ON. The control system 8 may be automatically turned ON with the turning ON of the paving machine 2, or alternatively, the control system 8 may be selectively turned ON when heating of the screed assembly 6 is desired. After turning ON the control system 8, the process proceeds to steps 54, 56 and 58, each of which is an input into the control system at a step 60. Although only the three inputs from the steps 54-58 are described herein, it will be understood that the control system 8 may receive additional inputs in other embodiments to control other aspects of the paving machine 2.

Particularly, at the step 54, the control system 8 may receive (or otherwise read) the outputs of the temperature sensors 28 from each of the six screed elements 13. The temperature sensors 28 provide the current temperatures of their respective screed elements 13. It will be understood that during initial start-up, although each of the six screed elements 13 may be at substantially similar temperatures, very minute (e.g., one tenth of a degree or less) temperature differences between the six screed elements may still exist, which the temperature sensors 28 may sense and provide to the control system 8.

Additionally, to determine the temperature to which each of the six screed elements need to be heated, a set point temperature at the step 56 may be input into the control system 8. The set point temperature may be user defined (or possibly defined by a computer) depending upon several factors, such as, the size of the screed assembly 6, the size of the generator 10 powering the screed elements, as well as the environmental conditions of the surroundings where the paving machine 2 (and the screed assembly 6) is employed. In at least some embodiments, the set point temperature may be specified as a low, medium or a high temperature, the values of which may be pre-defined, or in other embodiments, a temperature value may be directly input into the control system 8.

For those embodiments in which the set point temperature is set as low, medium, or high, an exemplary "low" set point temperature may be set to 220 degrees Fahrenheit, a medium set point temperature may be set to 240 degrees Fahrenheit and a high set point temperature may be set to 270 degrees Fahrenheit. In other embodiments, these values of the set point temperature may vary. By virtue of pre-defining values of the set point temperature, during heating of the screed elements 13, the set point temperature may be merely specified and input as "low" "medium" or "high." In at least some other embodiments, the set point temperature need not be set as low, medium or high values. Rather, a temperature value may be directly input into the control system 8 at the time of operation. Furthermore, in each of the above two cases, the set point temperature may be input directly into the control system 8, such as, via keypad connected to the control system or, alternatively, it may be supplied to (or read by) the control system from a separate entity.

In addition to the temperature readings from the temperature sensors 28 and the set point temperature at the steps 54 and 56, respectively, the control system 8 may receive an input of the load factor at the step 58. Specifically, the load factor is a percentage value that may be output by the engine (not shown) of the paving machine 2 to exemplify the load thereon. Depending upon the load on the engine, the control system 8 may decide upon the number of the heaters 30 to enable. In other words, if the load factor is high (e.g., 75%), indicating a higher load on the engine, then the control system 8 may cut down power from one or more of the screed elements 13 or alternatively, may only initially power fewer of the heaters 30 to heat fewer screed elements simultaneously. Similarly, if the load factor is low (e.g., 25%), the control system 8 may power more of the heaters 30 to heat more of the screed elements 13 at a time.

The values of the load factor and the corresponding number of the heaters 30 to enable for each of the load factor value may be pre-defined. For example, in at least some embodiments, for the six screed elements 13, a load factor value of 75% may only power two of the heaters 30, while for a load factor value 50%, three of the heaters may be powered. Similarly for a load factor value of 25%, four of the heaters 30 may be powered to heat four of the six screed elements 13 simultaneously. It will be understood that the above values of the load factor and the corresponding number of heaters to enable are exemplary and may change in other embodiments. By virtue of controlling heating of the screed elements 13 based upon the load factor, the engine of the paving machine 2 may be kept running and can be prevented from breaking down and malfunctioning during higher loads.

Thus, the control system 8 at the step 60 receives the temperatures of the screed elements 13 from the temperature sensors 28 at the step 54, the set point temperature from the step 56 and the load factor from the step 58. Upon receiving the aforementioned inputs, the control system 8 at a step 62 determines whether the set point temperature of each of the screed elements 13 has been reached or not. Typically, during the initial start up of the screed assembly 6, the temperature of the screed elements 13 of the screed assembly 6 may not be at the set point temperature. However, this may need not always be the case, especially when the screed assembly has been turned on shortly after being turned off and with the screed elements heated up to the set point temperature in that previous cycle.

Accordingly, if the control system 8 determines at the step 62 that the temperature of each of the screed elements 13 is already at the set point temperature, then the process terminates at a step 64. Otherwise, the process proceeds to a step 66. At the step 66, for the six screed elements 13, the control system 8 determines the coldest ones of those six screed elements. Depending upon the load factor value received from the step 58, the number of coldest elements that the control system 8 determines varies. Thus, for example, for a load factor of 25%, the control system 8 may determine that four of the heaters 30 may be enabled and, accordingly, four of the screed elements 13 may be heated simultaneously. So, the control system 8 may determine four of the coldest screed elements 13. The four coldest screed elements 13 may be determined by comparing the temperatures of each of the six screed elements received from their respective temperature sensors at the step 54.

After determining the number (e.g., four) of the screed elements 13 to simultaneously heat based upon the load factor, and determining the coldest of those number (e.g., four) of screed elements, the process proceeds at a step 68, where the control system 8 activates the relays 12. The number of the relays 12 to be activated depends upon the number of the screed elements 13 to be heated simultaneously determined at the step 66. Thus, for four of the coldest screed elements 13 that are specified at the step 66 to be heated at the same time, four of the relays 12 that are associated with those selected coldest ones of the screed elements are activated. As described above, the selected ones of the relays 12 can be activated by way of the output signal 36 generated by the control system 8 in response to the inputs 34 received thereby. Subsequent to activating the selected relays 12, those relays heat their respective screed elements 13 via the respective circuit breakers 11 through the generator 10, which powers the heaters 30, as shown by the communication links 38 and 40 in FIG. 2.

Next, at a step 70, the selected screed elements 13 are heated until there is a pre-set temperature difference between the screed elements being heated and the next coldest screed elements. The pre-set temperature is a temperature value (e.g., 5 degrees Fahrenheit) that may also be input into the control system 8 to determine when any one of the screed elements 13 being heated has reached the pre-set temperature above the next coldest of the remaining screed elements. For example, for the four of the coldest screed elements 13 being heated at the step 68, the control system 8 continuously monitors the temperatures of their respective temperature sensors 28 to determine when one of those screed elements reach a temperature difference of the pre-set temperature with the remaining (two) coldest one of the screed elements 13.

Thus, when one of the screed elements 13 being heated reach the pre-set temperature difference with the remaining cold screed elements, the process goes back to the step 62 for determining once again if the set point temperature for each of the six screed elements 13 has been reached or not. If not, the control system 8 again selects the four coldest screed elements at the step 66 and heats those at the step 68. On the other hand, if at the step 70, none of the screed elements 13 being heated have reached the pre-set temperature above the next coldest screed elements, those screed elements continue to be heated at a step 72 and being monitored for the pre-set temperature difference at the step 70. The above process of selectively heating four of the coldest screed elements 13 in smaller steps (based upon the pre-set temperature) continues until all of the six screed elements have been heated up to the set point temperature.

By virtue of heating the screed elements 13 in phases, the present disclosure prevents the screed elements from cycling (for heat) every few seconds. Furthermore, the aforementioned technique of heating the screed elements 13 ensures that all of the screed elements are heated uniformly, while implementing load management and preventing more than allowable power draw from a given generator size and without taxing the engine. This additionally prevents the disadvantages of the traditional schemes mentioned above, which suffer from potentially cold screed elements due to continuously heating the main elements while alternating power between the extenders and the BOE elements. Moreover, the desired heating of the screed elements 13 can be achieved using a smaller, comparatively inexpensive generator, which may additionally result in fuel savings and a lighter paving machine 2 in general.

It will be understood that although the above process has been explained with the screed assembly 6 having six of the screed elements 13, it is only exemplary. The above process will be equally applicable to screed assemblies having more than six screed elements or possibly even less than six. For these cases in which the number of screed elements is either greater or less than six, the load factor values may vary and correspondingly, the number of coldest screed elements determined at the step 66 for heating simultaneously may vary as well. Furthermore, although the flowchart 50 above has been explained with the steps 52-72 being in a specific order, this not be the case always. In at least some embodiments, the order of the steps may vary.

Figure 5:
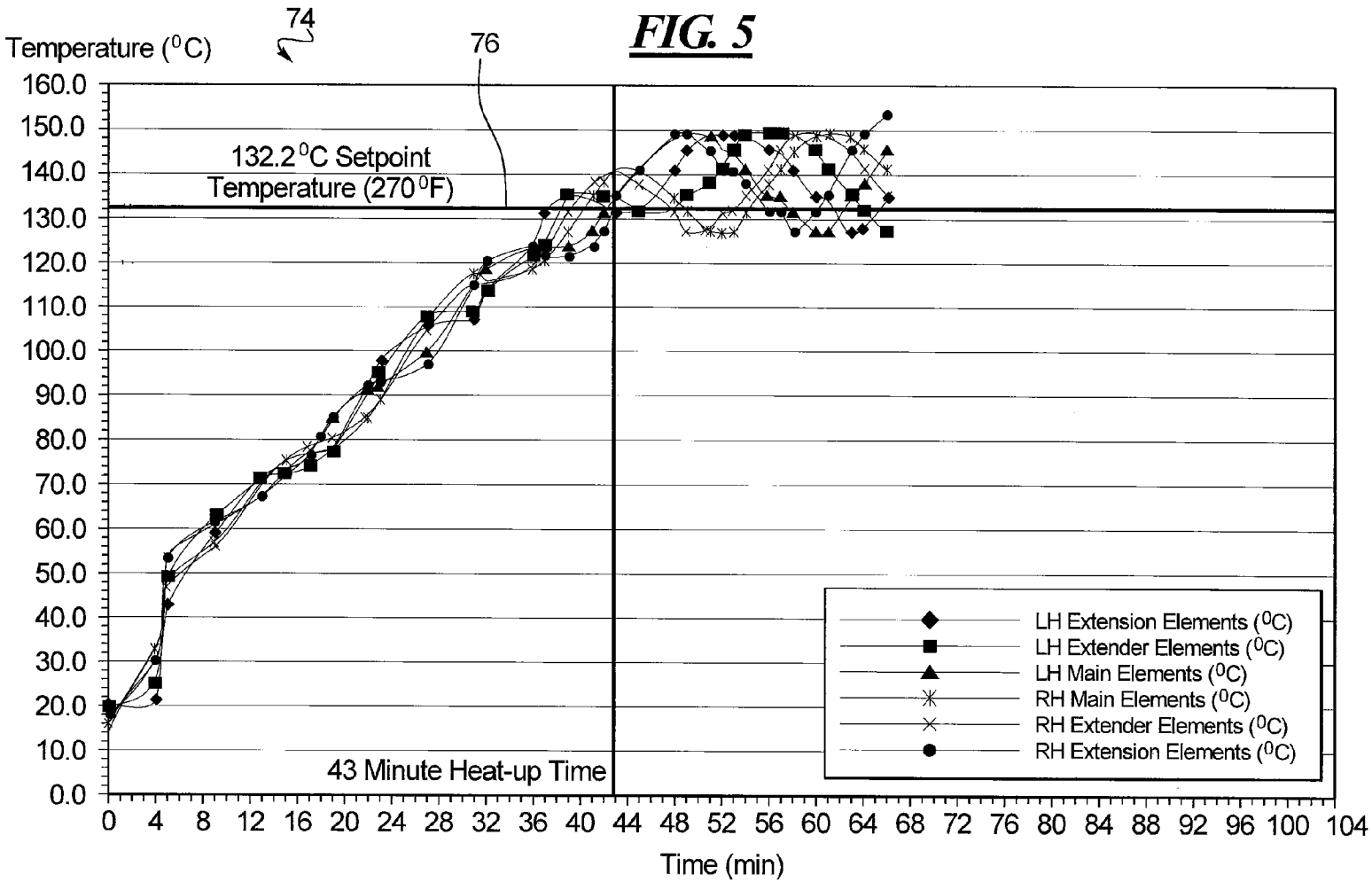
FIG. 5 is a graphical representation showing heating results of the screed assembly heated under control of the control system.

Turning now to FIG. 5, a graphical representation 74 shows the results of heating the screed elements 13 using the logic 50 described above. Specifically, the graphical representation 74 plots temperature in degree Celsius on the Y-axis against time in minutes on the X-axis. For each of the six screed elements 13, the increase in temperature with time is shown. It can be seen that each of the screed elements 13 is consistently heated, with the control system 8 heating each of those screed elements efficiently by not allowing large temperature swings when power is distributed between different sections. It can also be seen that for a set point temperature 76 of 132.2 degree Celsius, each of the screed elements 13 can be reached in forty three minutes. This is at least two minutes faster than traditional heating mechanisms.

Thus, the present disclosure provides an effective and efficient mechanism and control system for heating the screed assembly and, particularly, the screed elements of the screed assembly. Not only is a consistent heating performance obtained by the method above, it additionally provides savings in power usage, fuel usage, paving time, all while utilizing smaller sized generators and engines.

While only certain embodiments have been set forth, alternatives and modifications will be apparent from the above description to those skilled in the art. These and other alternatives are considered equivalents and within the spirit and scope of this disclosure and the appended claims.

What is claimed is:

1. A method to control heating of a screed assembly, the method comprising:

providing a plurality of screed elements in communication with a respective one of a plurality of circuit breakers through a respective one of a plurality of relays;

providing a control system in communication with the plurality of screed elements and the plurality of relays;

receiving inputs by the control system including a load factor indicative of a load on an engine of a tractor linked to the screed assembly;

determining by the control system a number of coldest ones of the plurality of screed elements to be heated simultaneously based upon the load factor, and generating an output signal;

heating the number of coldest ones of the plurality of screed elements simultaneously in response to the output signal;

determining by the control system whether any of the number of coldest ones of the plurality of screed elements being heated simultaneously has heated up to a pre set temperature difference with remaining of the plurality of screed elements; and replacing the ones of the plurality of screed elements whose pre set temperature is reached with at least one of the remaining next coldest of the plurality of screed elements.

2. The method of claim 1, wherein the inputs received by the control system further include:

a temperature reading from each of the plurality of screed elements; and a set point temperature.

3. The method of claim 1, wherein generating an output signal further comprises determining whether a set point temperature for each of the plurality of screed elements is reached or not.

4. The method of claim 1, wherein heating the plurality of screed elements comprises:

activating respective ones of the plurality of relays associated with the plurality of screed elements being heated.

5. The method of claim 4, wherein heating each of the plurality of screed elements further comprises activating the respective ones of the plurality of the circuit breakers associated with through the respective activated ones of the plurality of relays.

6. The method of claim 1, further comprising:

continuing selective heating of the plurality of screed elements until all of the plurality of screed elements reach a set point temperature.

7. A paving machine, comprising:

a screed assembly having a plurality of screed elements;

a generator driven by an engine and having a plurality of circuit breakers, each of the plurality of circuit breakers in communication with a respective one of the plurality of screed elements;

a plurality of relays in communication with a respective one of the plurality of circuit breakers; and a control system capable of receiving a plurality of inputs and generating an output to selectively activate the plurality of relays, wherein the plurality of inputs include a load factor indicative of a load on the engine and selectively activating the plurality of relays includes determining, based upon the load factor, a number of coldest ones of the plurality of screed elements to be heated simultaneously until a pre set temperature difference with remaining of the plurality of screed elements is reached, the control system further capable of replacing the ones of the plurality of screed elements whose pre set temperature is reached with at least one of the remaining next coldest of the plurality of screed elements.

8. The paving machine of claim 7, wherein the plurality of screed elements comprises a main screed plate, the main screed plate having a left main screed element and a right main screed element.

9. The paving machine of claim 8, wherein the plurality of screed elements further comprises left and right extenders and left and right bolt-on extensions.

10. The paving machine of claim 7 wherein the plurality of screed elements comprises six screed elements.

11. The paving machine of claim 7, wherein the plurality of circuit breakers comprises six circuit breakers and the plurality of relays comprises six relays.

12. The paving machine of claim 7, wherein each of the plurality of screed elements has associated therewith a temperature sensor.

13. The paving machine of claim 12, wherein the plurality of inputs to the control system include temperature readings from each of the plurality of screed elements through the respective temperature sensor.

14. The paving machine of claim 7, wherein the plurality of inputs comprises a set point temperature.

15. A method of heating a screed assembly, the method comprising;

providing a screed assembly having six screed elements, each of the six screed elements connected to a respective circuit breaker through a respective relay;

providing a control system receiving inputs from each of the six screed elements and receiving a load factor indicative of a load on an engine of a tractor linked to the screed assembly;

determining by the control system a number of coldest ones of the six screed elements to be heated simultaneously based upon the load factor;

activating the relays of the number of coldest ones of the six screed elements;

heating the four coldest of the number of coldest ones six screed elements through their respective circuit breakers based on the received inputs;

determining whether any one of the number of coldest ones of the six screed elements being heated simultaneously has reached a pre set temperature difference with the remaining of the six screed elements; and heating the next four coldest screed elements if the pre set temperature is reached.

16. The method of claim 15, further comprising receiving a set point temperature as input into the control system.

17. The method of claim 15, further comprising heating the six screed elements until a set point temperature is reached.

18. The method of claim 15, wherein the number includes up to four of the six screed elements to be heated simultaneously based upon the load factor.

* * * * *